US009345070B2

(12) United States Patent
Long et al.

(10) Patent No.: US 9,345,070 B2
(45) Date of Patent: May 17, 2016

(54) VARIABLE PITCH RESISTANCE COIL HEATER

(71) Applicant: Watlow Electric Manufacturing Company, St. Louis, MO (US)

(72) Inventors: Dennis P. Long, Monroe City, MO (US); Rolando O. Juliano, Vista, CA (US)

(73) Assignee: Watlow Electric Manufacturing Company, St. Louis, MO (US)

( * ) Notice: Subject to any disclaimer, the term of this patent is extended or adjusted under 35 U.S.C. 154(b) by 0 days.

(21) Appl. No.: 14/744,654

(22) Filed: Jun. 19, 2015

(65) Prior Publication Data

US 2015/0289320 A1 Oct. 8, 2015

Related U.S. Application Data

(63) Continuation of application No. 13/481,667, filed on May 25, 2012, now Pat. No. 9,113,501.

(51) Int. Cl.

| | |
|---|---|
| ***F24H 1/10*** | (2006.01) |
| ***H01C 3/08*** | (2006.01) |
| ***H05B 3/08*** | (2006.01) |
| ***H05B 3/12*** | (2006.01) |
| ***H05B 3/44*** | (2006.01) |
| ***H05B 3/48*** | (2006.01) |
| ***H05B 3/82*** | (2006.01) |
| ***H05B 3/42*** | (2006.01) |
| ***H05B 3/00*** | (2006.01) |
| ***H05B 3/52*** | (2006.01) |

(52) U.S. Cl.

CPC ..... *H05B 3/42* (2013.01); *F24H 1/103* (2013.01); *H01C 3/08* (2013.01); *H05B 3/0014* (2013.01); *H05B 3/12* (2013.01); *H05B 3/44* (2013.01); *H05B 3/48* (2013.01); *H05B 3/52* (2013.01); *H05B 3/82* (2013.01); *H05B 2203/014* (2013.01); *H05B 2203/037* (2013.01)

(58) Field of Classification Search

None

See application file for complete search history.

(56) References Cited

U.S. PATENT DOCUMENTS

| | | | | |
|---|---|---|---|---|
| 3,500,018 | A * | 3/1970 | Stiller | 219/463.1 |
| 3,538,374 | A * | 11/1970 | Kane | 313/273 |
| 4,526,732 | A * | 7/1985 | Kakii et al. | 264/2.7 |
| 4,740,674 | A * | 4/1988 | Tsutsumi | 219/523 |
| 5,310,979 | A * | 5/1994 | Jung et al. | 219/680 |
| 5,386,491 | A * | 1/1995 | Mewissen et al. | 392/418 |
| 5,774,627 | A * | 6/1998 | Jackson | 392/497 |
| 8,791,396 | B2 * | 7/2014 | Burns et al. | 219/542 |
| 9,113,501 | B2 * | 8/2015 | Long et al. | |
| 2009/0283515 | A1 * | 11/2009 | Sopory et al. | 219/549 |
| 2011/0292144 | A1 * | 12/2011 | Gellida et al. | 347/102 |
| 2012/0018420 | A1 * | 1/2012 | Whitney et al. | 219/544 |

FOREIGN PATENT DOCUMENTS

GB 2224074 A * 4/1990

* cited by examiner

*Primary Examiner* — Joseph M Pelham

(74) *Attorney, Agent, or Firm* — Burris Law, PLLC

(57) ABSTRACT

A heater is provided that includes a resistance coil assembly defining a first end portion having a first conducting pin and a second end portion having a second conducting pin, and a resistance coil disposed between the first end portion and the second end portion, and a first zone adjacent the first end portion with a constant pitch. The resistance coil further defines a continuously variable pitch extending along a length of the resistance coil from the first zone to the second end portion. The continuously variable pitch provides a variable watt density such that a predetermined temperature profile is provided along the sheath.

20 Claims, 9 Drawing Sheets

VARIABLE PITCH RESISTANCE COIL HEATER

CROSS-REFERENCE TO RELATED APPLICATIONS

This application is a continuation of U.S. patent application Ser. No. 13/481,667, filed on May 25, 2012. The disclosure of the above application is incorporated herein by reference.

FIELD

The present disclosure relates to electric heaters, and more specifically to electric heaters that use resistance coils to generate heat.

BACKGROUND

The statements in this section merely provide background information related to the present disclosure and may not constitute prior art.

Tubular heaters generally include a resistance coil, an insulating material surrounding the resistance coil, and a tubular sheath surrounding the insulating material. The resistance coil is connected to a pair of conducting pins which protrude from the tubular sheath for connecting to a power source. The resistance coil generates heat, which is transferred to the tubular sheath, which in turn heats a surrounding environment or part.

Tubular heaters are commonly used in heat exchangers. The heat capacity rate of the heat exchanger depends on the heat generation capability of the tubular heater, particularly, the resistance coil. To increase the heat capacity rate of the heat exchanger, more tubular heaters may be provided in the heat exchanger, resulting in a bulky structure. Moreover, heat exchangers using the typical tubular heaters may have performance problems such as increased hydrocarbons and severe fouling at an outlet due to overheating, which eventually leads to failure.

SUMMARY

In one form, the present disclosure provides a resistance element for use in a heater as a resistance coil having a first end portion and a second end portion. The resistance coil defines a first zone adjacent the first end portion having a constant pitch. A continuously variable pitch extends a length from the first zone of the resistance coil to the second end portion. The continuously variable pitch provides a variable watt density such that a predetermined temperature profile is provided to a heating target.

In another form, a heater includes a resistance coil assembly defining a first end portion having a first conducting pin and a second end portion having a second conducting pin. The resistance coil assembly comprises a resistance coil having a first end portion and a second end portion. The resistance coil defines a first zone adjacent the first end portion having a constant pitch. A continuously variable pitch extends from the first zone along a length of the resistance coil to the second end portion. An insulating material surrounds the resistance coil assembly, and a sheath surrounds the insulating material. The continuously variable pitch provides a variable watt density such that a predetermined temperature profile is provided along the sheath.

In still another form, an electric heat exchanger includes a heater. The heater comprises a resistance coil having a first end portion and a second end portion and the resistance coil defines a first zone adjacent the first end portion having a constant pitch. A continuously variable pitch extends from the first zone along a length of the resistance coil to the second end portion. An insulating material surrounds the resistance coil assembly, and a sheath surrounds the insulating material. The continuously variable pitch provides a variable watt density such that a predetermined temperature profile is provided along the sheath.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

In order that the invention may be well understood, there will now be described an embodiment thereof, given by way of example, reference being made to the accompanying drawing, in which.

Corresponding reference numerals indicate corresponding parts throughout the several views of the drawings.

DETAILED DESCRIPTION

The following description is merely exemplary in nature and is not intended to limit the present disclosure, application, or uses.

Figure 1:
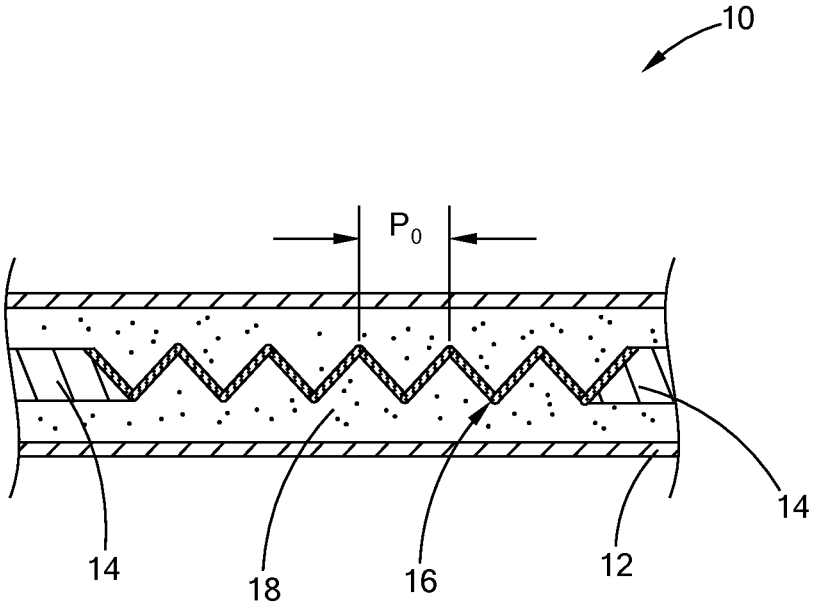
FIG. 1 (PRIOR ART)
FIG. 1 is a cross-sectional view of a prior art tubular heater.

Referring to FIG. 1, a typical tubular heater 10 generally includes a tubular outer sheath 12, a pair of conducting pins 14 protruding from opposing ends of the tubular outer sheath 12, a resistance coil 16 disposed between the conducting pins 14, and an insulating material 18. The resistance coil 16 generally includes resistance-type metal alloy and is formed into a helical coil shape. The resistance coil 16 generally has a constant pitch $P_0$ along the length of the resistance coil 16 to provide uniform heating along the length of the tubular outer sheath 12. The insulating material 18, such as magnesium oxide, is provided inside the tubular outer sheath 12 to surround and electrically insulates the resistance coil 16.

Figure 2:
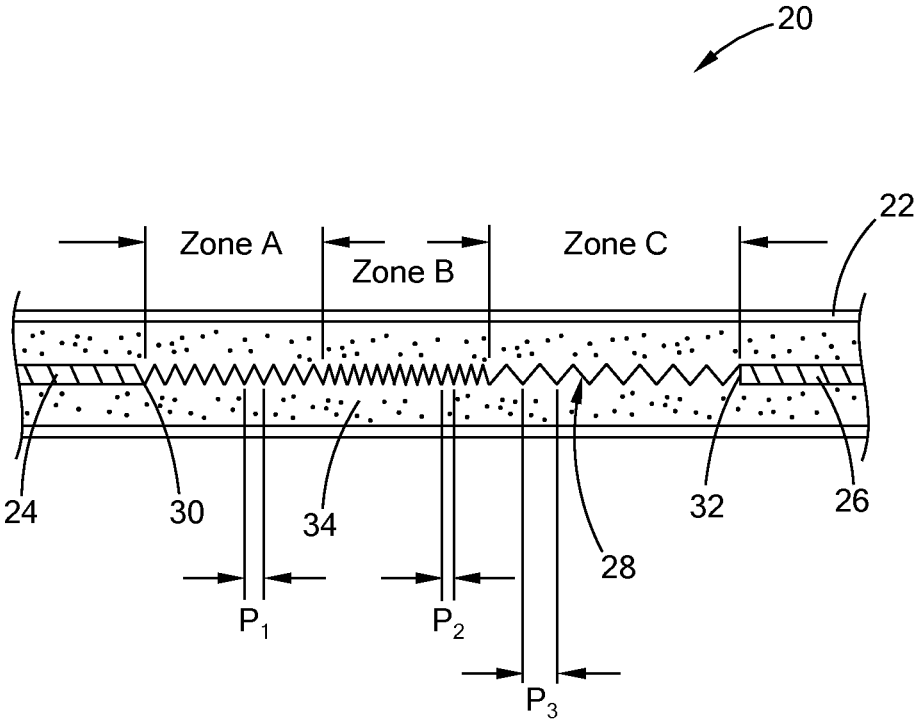
FIG. 2 is a cross-sectional view of a tubular heater constructed in accordance with the teachings of the present disclosure.

Referring to FIG. 2, a tubular heater 20 constructed in accordance with the teachings of the present disclosure includes a tubular outer sheath 22, first and second conducting pins 24 and 26, and a resistance coil 28 disposed between the first and second conducting pins 24 and 26. The resistance coil 28 includes helical coils having a constant outside diameter. The resistance coil 28 has a first end portion 30 connected to the first conducting pin 24 and a second end portion 32 connected to the second conducting pin 26. The resistance coil 28 and the first and second conducting pins 24 and 26 form a resistance coil assembly. The resistance coil 28 defines a plurality of zones having different pitches. While three zones A, B, C are shown, it is understood that the resistance coil 28 may have any number of zones without departing from the scope of the present disclosure.

As shown, the resistance coil 28 has pitches $P_1$, $P_2$, and $P_3$ in zones A, B, and C, respectively. P3 is greater than P1, and P1 is greater than P2. The resistance coil 28 has a constant pitch along the length of each zone. A first zone A with a pitch P1 is provided proximate the first end portion 30. A second zone B with a pitch P2 is provided at a middle portion and adjacent the first zone A. A third zone C with a pitch P3 is provided adjacent the second zone B and the second end portion 32. The plurality of different pitches P1, P2, and P3 in the plurality of zones A, B and C provide a variable watt density such that a predetermined temperature profile is provided along the length of the tubular outer sheath 22. The pitches P1, P2 and P3 in zones A, B and C are determined based on a desired temperature profile along the length of the outer tubular sheath 22. The predetermined temperature profile may be constant to provide uniform heating along the length of the outer tubular sheath 22. Alternatively, the predetermined temperature profile may be varied to provide varied heating along the length of the outer tubular sheath 22, taking into account the heat sinks proximate the outer tubular sheath 22 or the temperature gradient of the fluid along the outer tubular sheath 22. The plurality of different pitches may be, by way of example, in the range of approximately 1.5 inches (38.1 mm) to approximately 4.5 inches (114.3 mm). An insulating material 34 surrounds the resistance coil 28 and fills in the tubular outer sheath 22. The insulating material 34 is a compacted Magnesium Oxide (MgO) in one form of the present disclosure. In other forms, an insulating material such as MgO may be mixed with other materials such as Boron Nitride (BN) in order to improve heat transfer characteristics. It should be understood that these insulating materials 34 are exemplary and thus should not be construed as limiting the scope of the present disclosure.

Figure 3:
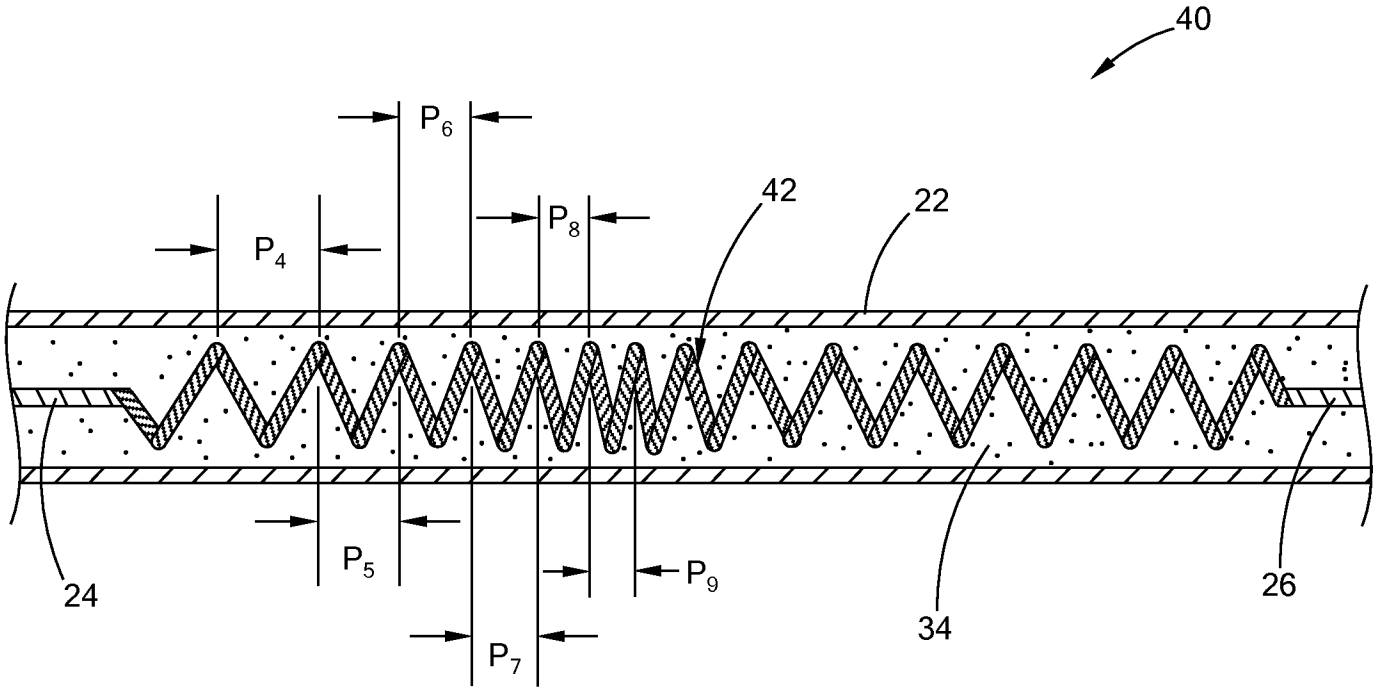
FIG. 3 is a cross-sectional view of another form of a tubular heater constructed in accordance with the teachings of the present disclosure.

Referring to FIG. 3, a tubular heater 40 constructed in accordance with the teachings of the present disclosure has a structure similar to that of FIG. 2, except for the resistance coil 42. The resistance coil 42 in this embodiment has a continuously variable pitch with the ability to accommodate an increasing or decreasing pitch $P_4$-$P_8$ on the immediately adjacent next 360 degree coil loop. The continuously variable pitch of the resistance coil 42 allows the resistance coil 42 to provide gradual changes in the flux density of a heater surface (i.e., the surface of the outer tubular sheath 22).

The resistance coil 28 with different pitches ($P_1$, $P_2$, $P_3$) in different zones A, B, C or the resistance coil 42 with continuously variable pitches ($P_4$ to $P_8$) may be produced by using a constant-pitch coil. A knife-edge-like device is used to hold the opposing ends of a section/zone of the coil and stretch or compress the coil in the same section/zone to the desired length to adjust the pitch in the section/zone. The resistance coil 28 may include a material such as nichrome and may be formed by using nichrome resistance wire in the full annealed state or in a "full hard" condition. The hardness of a metal is directly proportional to the uniaxial yield stress. A harder metal has higher resistance to plastic deformation and thus aids the process of producing the coil with the desired zoned-pitch or continuously variable pitch. In addition to nichrome 80/20, other resistance alloys may be used to form resistance coils with zoned-pitch or continuously variable pitch. When nichrome is used, the pitch of the coil may be in a range of approximately 0.5 to approximately 2.5 times the diameter of the resistance coil 28. When other materials are used for the resistance coil 28, the coil may have a larger or smaller pitch range, and thus the values set forth herein are merely exemplary and should not be construed as limiting the scope of the present disclosure.

The resistance wire that is used to form the resistance coil 28 or 42 may have a cross section of any shape, such as circular, rectangular, or square without departing from the scope of the present disclosure. A non-circular cross section is likely to exhibit better resistance to plastic deformation.

Figure 4:
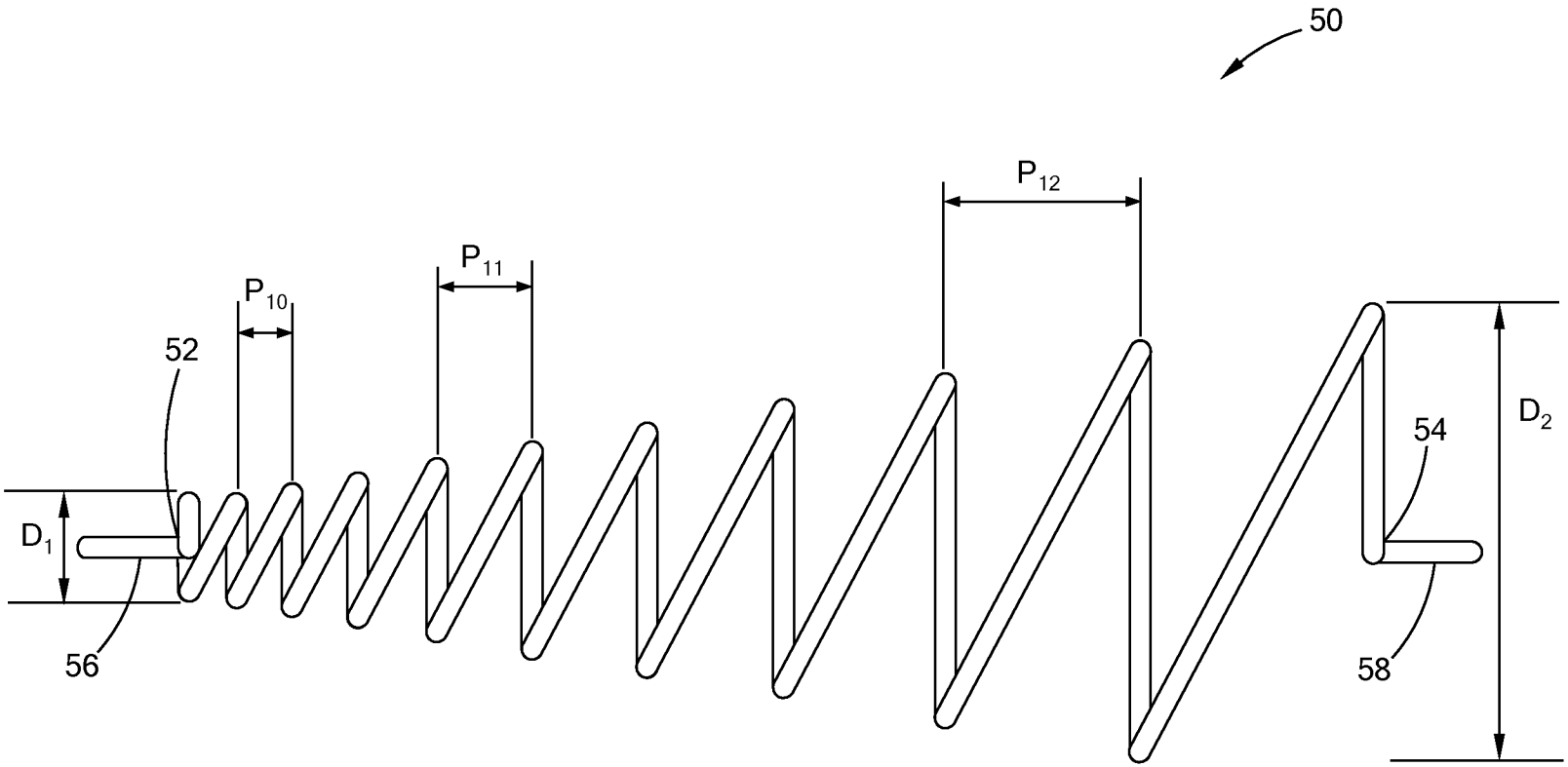
FIG. 4 is a schematic view of a resistance coil that can be used in a tubular heater constructed in accordance with the teachings of the present disclosure.
Figure 5:
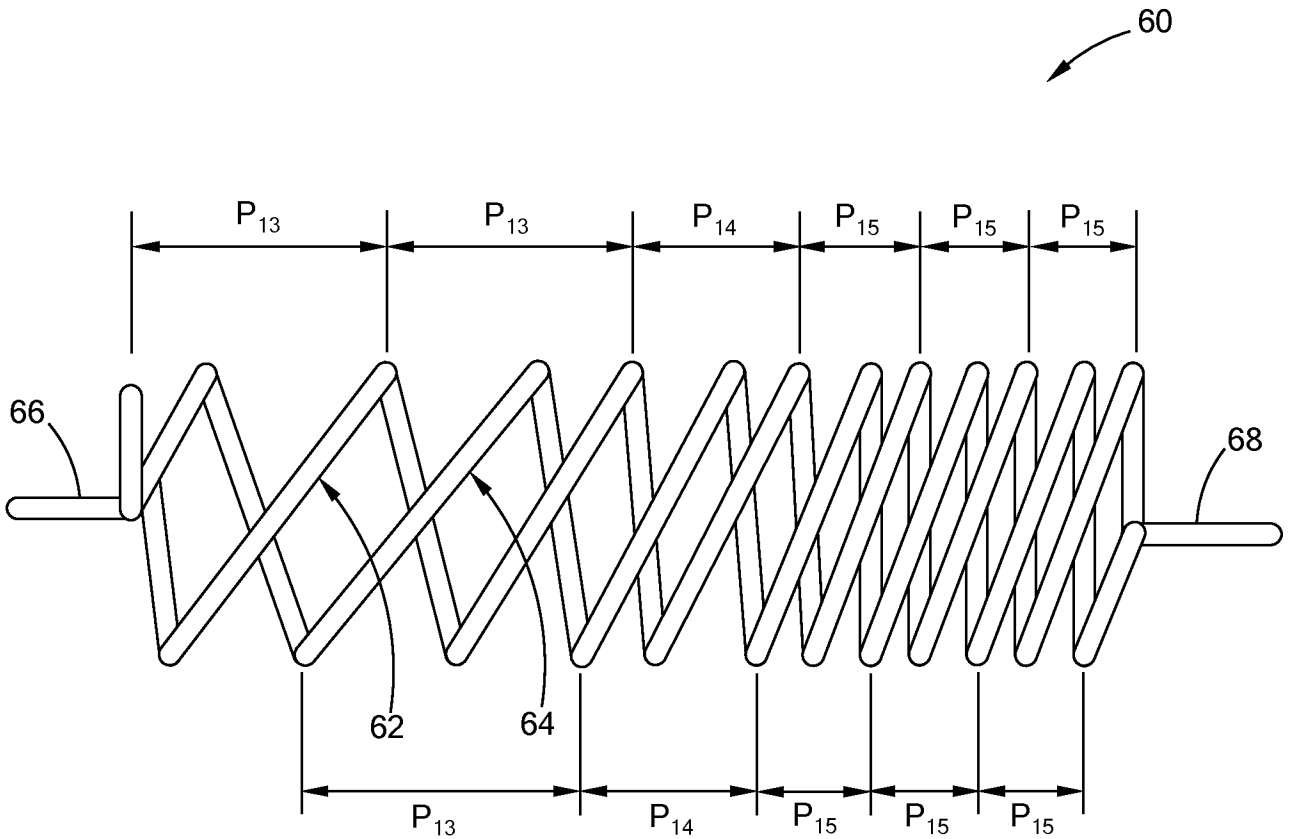
FIG. 5 is a schematic view of another form of a resistance coil that can be used in a tubular heater constructed in accordance with the teachings of the present disclosure.
Figure 6:
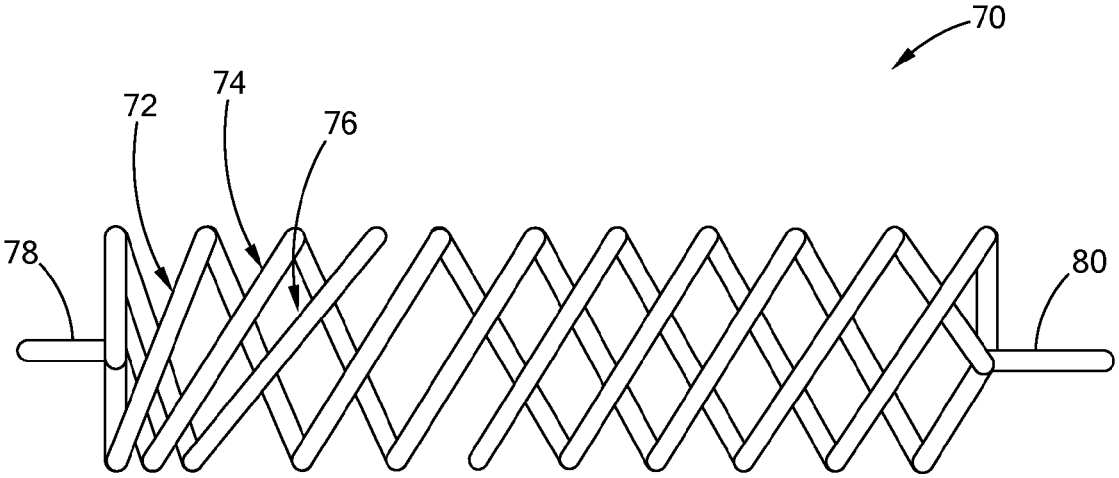
FIG. 6 is a schematic view of still another form of a resistance coil that can be used in a tubular heater constructed in accordance with the teachings of the present disclosure.

Referring to FIGS. 4 to 6, the resistance coil 28 may have a different configuration. As shown in FIG. 4, the resistance coil 50 may have a conical shape with varied outside diameters. For example, the resistance coil 50 may have the smallest outside diameter $D_1$ at a first end portion 52 proximate a first conducting pin 56 and have the largest outside diameter $D_2$ at a second end portion 54 proximate a second conducting pin 58. The resistance coil 50 may have a zoned-pitch or continuously variable pitches ($P_{10}$-$P_{12}$) along the length of the resistance coil 50.

The resistance coil may alternatively have double-helix or triple-helix as shown in FIGS. 5 and 6, respectively. In FIG. 5, the resistance coil 60 has a double helix and includes a first helix element 62 and a second helix element 64. The first and second helix elements 62 and 64 are formed around the same axis and connected to the first and second conducting pins 66 and 68 to form a parallel circuit. The first and second helix elements 62 and 64 may have zoned-pitches ($P_{13}$, $P_{14}$, $P_{15}$) or continuously-variable pitch. In FIG. 6, the resistance coil 70 is shown to have a triple helix and includes a first helix element 72, a second helix element 74 and a third helix element 76, which are connected to a first conducting pin 78 and a second conducting pin 80 to form a parallel circuit.

Figure 7:
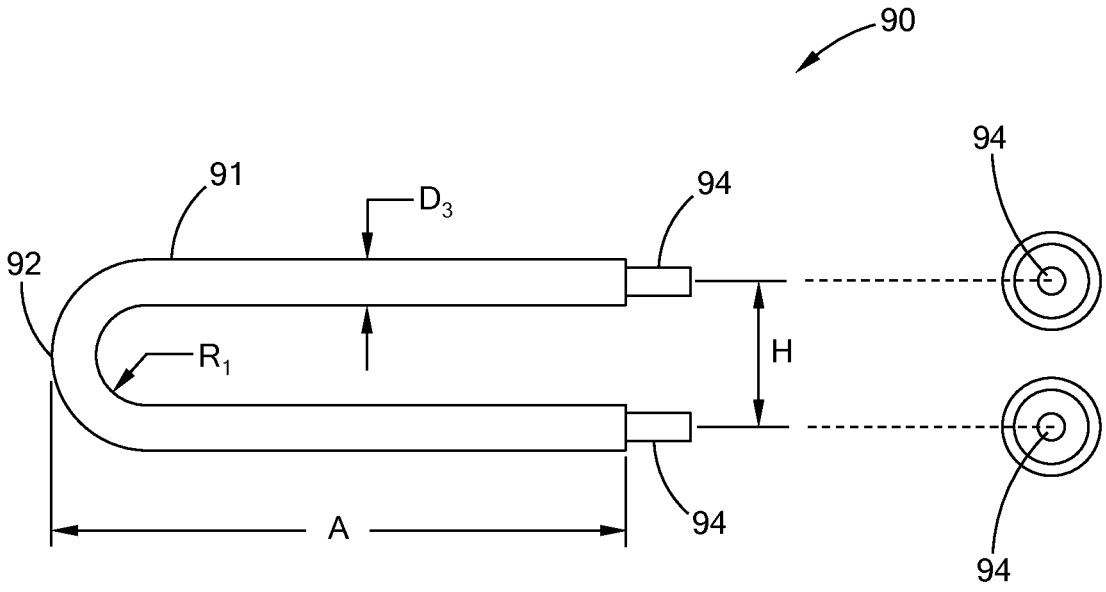
FIG. 7 is a plan view and a side view of a variant of a tubular heater constructed in accordance with the teachings of the present disclosure.

Referring to FIG. 7, a variant of a tubular heater 90 constructed in accordance with the teachings of the present disclosure is shown to define a U shape and include a hairpin bend 92. (It should also be understood, that any bend configuration such as a 45° or 90° bend may be employed as a variant of the tubular heater 90, and thus the 180° hairpin configuration should not be construed as limiting the scope of the present disclosure). The variable-pitch configurations as set forth above may be employed within this hairpin bend 92 portion in order to reduce current crowding. The tubular heater 90 may be used in direct type electric heat exchangers (shown in FIGS. 8 and 9) or indirect type electric heat exchangers.

As shown, the tubular heater 90 includes a tubular outer sheath 91 defining the hairpin bend 92, and a pair of conducting pins 94 protruding from opposing ends of the tubular outer sheath 91. The pair of conducting pins 94 are arranged in parallel and spaced apart by a distance H. The hairpin bend 92 has a curvature that defines a radius R. The tubular outer sheath 91 has an outside diameter of $D_3$. The tubular heater 90 includes a resistance coil (not shown in FIG. 7), which may have zoned-pitches as shown in FIG. 2 or continuously-variable pitches as shown in FIG. 3.

Figure 8:
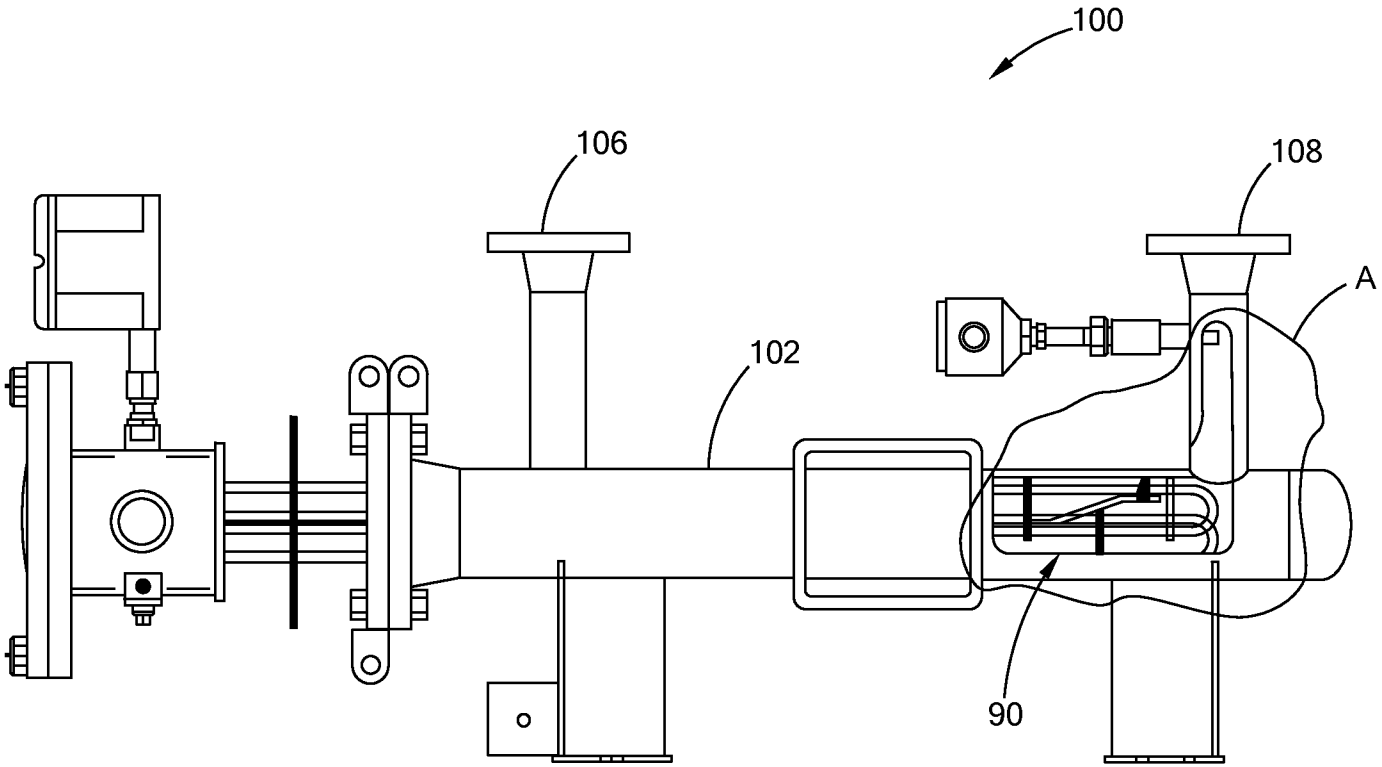
FIG. 8 is a side view of an electric heat exchanger that employs a tubular heater constructed in accordance with the teachings of the present disclosure.

Referring to FIG. 8, a heat exchanger that includes a plurality of tubular heaters 90 is shown and generally indicated by reference numeral 100. The heat exchanger 100 is a direct electric heat exchanger, which includes an outer tube 102 surrounding a plurality of tubular heaters 90. The outer tube 102 includes an inlet 106 and an outlet 108. The fluid to be heated flows in and out the outer tube 102 through the inlet 106 and the outlet 108.

Figure 9:
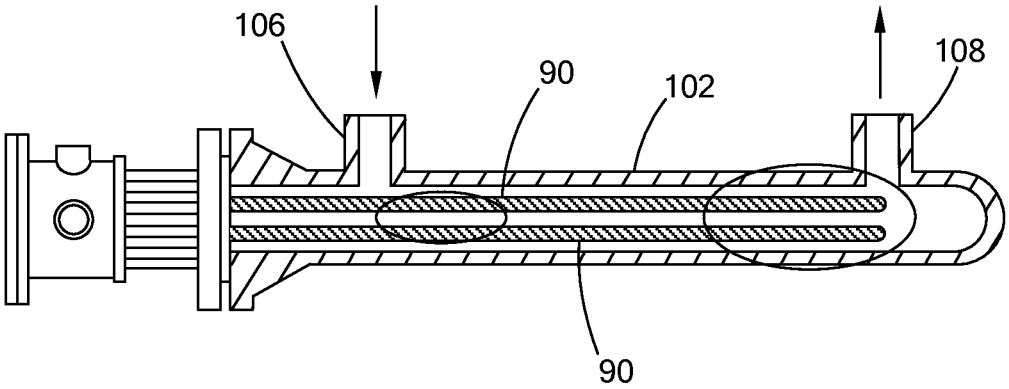
FIG. 9 is a partial cross-sectional view of the electric heat exchanger of FIG. 8.

Referring to FIG. 9, the tubular heaters 90 extend from the inlet 106 to the outlet 108 and have hairpin bends 92 disposed proximate the outlet 108. As the fluid enters the inlet 102, the fluid is gradually heated by the tubular heaters 90 until the fluid leaves the outer tube 102 through the outlet 108. The fluid proximate the inlet 106 is cooler than the fluid proximate the outlet 108.

In a typical direct heat exchanger, the tubular heaters have constant-pitch resistance coils in order to provide constant heat flux density (i.e., watt density) along the length of the outer tubular sheaths of the tubular heaters. The watt density is normally specified or calculated to limit the maximum sheath temperature for purposes of preventing degradation of the heated medium, and/or to achieve a desired heater durability, and/or for other safety reasons. Since the watt density is constant along the length of the tubular heaters, the sheath temperature varies depending on a number of thermodynamic factors, including the temperature gradient of the fluid along the tubular heaters, the flow rate of the fluid.

The heat exchangers that employ the typical tubular heaters generally have performance problems such as increased hydrocarbons and "coking" at the outlet. The fluid proximate the inlet is cooler than the fluid proximate the outlet. When the typical tubular heater provides uniform heating along the length of the tubular heater, the fluid proximate the inlet may not be heated rapidly enough, whereas the fluid proximate the outlet may be overheated, resulting in increased hydrocarbons and "coking" at the outlet. By using the resistance coil having variable pitch, the tubular heater may be designed to generate more heat proximate the inlet, and less heat proximate the outlet. Therefore, the heat exchangers that include the resistance coils of the present disclosure can rapidly increase the temperature of the fluid without overheating the fluid at the outlet.

Moreover, the tubular heater constructed in accordance with the teachings of the present disclosure can be installed in an existing heat exchanger to change the heating profile if desired. Engineering mistakes may be made when heat exchangers are designed, such as a mistake in the kilowatt rating being too low. The tubular heaters of the present disclosure can replace the existing heaters to provide a higher kilowatt bundle in the same heat exchanger package/size/footprint by changing the pitches of the resistance coil. Moreover, an existing prior art heater can be redesigned to provide a lower average watt density and/or sheath temperature, resulting in longer durability.

A tubular heater employing a resistance coil with continuously variable pitch generates a continuously variable watt density along the length of the outer tubular sheath. Therefore, the tubular heater of the present disclosure has the advantages of reducing the size of the tubular heater, and hence the heat exchanger, thereby reducing the manufacturing costs and footprint.

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A resistance element for use in a heater comprising:

a resistance coil having a first end portion and a second end portion, the resistance coil defining:

a first zone adjacent the first end portion, the first zone defining a constant pitch; and a continuously variable pitch extending from the first zone along a length of the resistance coil to the second end portion, wherein the continuously variable pitch provides a variable watt density such that a predetermined temperature profile is provided to a heating target.

2. The resistance element according to claim 1, wherein the first zone of the resistance coil defines a varied outside diameter.

3. The resistance element according to claim 2, wherein the first zone of the resistance coil defines a taper having a gradually increasing outside diameter along the length from the first end portion toward the continuously variable pitch of the resistance coil.

4. The resistance element according to claim 1, wherein the resistance coil defines a double helix comprising a first helix element and a second helix element.

5. The resistance element according to claim 4, wherein the resistance coil defines a triple helix further comprising a third helix element.

6. The resistance element according to claim 1, wherein the resistance coil has a cross-sectional shape selected from one of circular, rectangular, and square.

7. The resistance element according to claim 1, wherein the resistance coil defines a diameter and at least one of the constant pitch or the continuously variable pitch of the resistance coil is in a range of approximately 0.5 to approximately 2.5 times the diameter of the resistance coil.

8. The resistance element according to claim 7, wherein the resistance coil is made of nichrome.

9. A heater comprising:

a resistance coil assembly defining a first end portion having a first conducting pin and a second end portion having a second conducting pin, the resistance coil assembly comprising:

a resistance coil having a first end portion and a second end portion, the resistance coil defining:

a first zone adjacent the first end portion, the first zone defining a constant pitch, and a continuously variable pitch extending from the first zone along a length of the resistance coil to the second end portion;

an insulating material surrounding the resistance coil assembly; and a sheath surrounding the insulating material, wherein the continuously variable pitch provides a variable watt density such that a predetermined temperature profile is provided along the sheath.

10. The heater according to claim 9, wherein the first zone of the resistance coil defines a varied outside diameter.

11. The heater according to claim 10, wherein the first zone of the resistance coil defines a taper having a gradually increasing outside diameter along the length from the first end portion toward the continuously variable pitch of the resistance coil.

12. The heater according to claim 9, wherein the heater further defines a hairpin bend along a portion of the resistance coil having the continuously variable pitch.

13. The heater according to claim 12, wherein the hairpin bend is approximately 180 degrees to define the heater in a U-shape with the first and second conducting pins arranged in parallel.

14. The resistance element according to claim 9, wherein the resistance coil has a cross-sectional shape selected from one of circular, rectangular, and square.

15. An electric heat exchanger comprising:

a heater comprising:

a resistance coil having a first end portion and a second end portion, the resistance coil defining:

a first zone adjacent the first end portion, the first zone defining a constant pitch, and a continuously variable pitch extending from the first zone along a length of the resistance coil to the second end portion;

an insulating material surrounding the resistance coil assembly; and a sheath surrounding the insulating material, wherein the continuously variable pitch provides a variable watt density such that a predetermined temperature profile is provided along the sheath.

16. The electric heat exchanger according to claim 15, wherein the heater further defines a hairpin bend along a portion of the resistance coil having the continuously variable pitch.

17. The electric heat exchanger according to claim 16, wherein the hairpin bend is approximately 180 degrees to define the heater in a U-shape with the first and second conducting pins arranged in parallel.

18. The electric heat exchanger according to claim 15, wherein the first zone of the resistance coil defines a varied outside diameter.

19. The electric heat exchanger according to claim 18, wherein the first zone of the resistance coil defines a taper having a gradually increasing outside diameter along the length from the first end portion toward the continuously variable pitch of the resistance coil.

20. The electric heat exchanger according to claim 15, wherein the heat exchanger further comprises an outer tube surrounding the heater and the outer tube defines an inlet and an outlet.

* * * * *